US009359161B2

(12) United States Patent
Huang et al.

(10) Patent No.: US 9,359,161 B2
(45) Date of Patent: Jun. 7, 2016

(54) INTERLEAVING ELEMENT FOR A ROLL OF GLASS SUBSTRATE

(71) Applicant: Industrial Technology Research Institute, Hsinchu (TW)

(72) Inventors: Chia-Sheng Huang, Luodong Township, Yilan County (TW); Hsin-Yun Hsu, Zhudong Township, Hsinchu County (TW); Jyun-Kai Ciou, Yuanlin Township, Changhua County (TW)

(73) Assignee: INDUSTRIAL TECHNOLOGY RESEARCH INSTITUTE, Chutung, Hsinchu (TW)

( * ) Notice: Subject to any disclaimer, the term of this patent is extended or adjusted under 35 U.S.C. 154(b) by 227 days.

(21) Appl. No.: 14/136,869

(22) Filed: Dec. 20, 2013

(65) Prior Publication Data

US 2015/0175471 A1 Jun. 25, 2015

(51) Int. Cl.
*B32B 3/00* (2006.01)
*B65H 18/10* (2006.01)

(52) U.S. Cl.
CPC .. *B65H 18/103* (2013.01); *B65H 2301/414324* (2013.01); *B65H 2801/61* (2013.01); *Y10T 428/24182* (2015.01)

(58) Field of Classification Search
CPC ..... B32B 1/00; B32B 3/00; B32B 17/06; B32B 17/065; B32B 17/064; B32B 17/061; Y10T 428/24182; C03B 40/00; B65H 18/103; B65H 2801/61; B65H 2301/414324
USPC ..... 428/78, 189, 426, 906
See application file for complete search history.

(56) References Cited

U.S. PATENT DOCUMENTS

| | | | | |
|---|---|---|---|---|
| 4,258,846 | A | 3/1981 | Campo | |
| 2005/0053768 | A1 | 3/2005 | Friedman et al. | |
| 2005/0196584 | A1 | 9/2005 | Halecki et al. | |
| 2008/0185701 | A1* | 8/2008 | Foust | H01L 51/5237 257/682 |
| 2011/0023548 | A1 | 2/2011 | Garner et al. | |
| 2014/0170378 | A1* | 6/2014 | Bellman | C03C 17/002 428/141 |

FOREIGN PATENT DOCUMENTS

| | | | |
|---|---|---|---|
| CN | 102482135 | A | 5/2012 |
| JP | 2013079181 | A | 5/2013 |

(Continued)

OTHER PUBLICATIONS

Chia-Sheng Huang, et al., "Roll-to-roll Process on Ultra-thin Flexible Glass for Manufacturing the Multi-Touch Sensor Panel", Distringuished Paper, SID 2013 Digest, 2013, pp. 807-809.

(Continued)

*Primary Examiner* — Catherine A Simone
(74) *Attorney, Agent, or Firm* — Muncy, Geissler, Olds & Lowe, P.C.

(57) ABSTRACT

An interleaving element is adapted to interleave a roll of glass substrate. The glass substrate includes at least one active area, a plurality of spacing zones and two edge zones. The plurality of spacing zones and the edge zones define the active area. The interleaving element includes two elongated side elements and a plurality of bridging elements. The elongated side elements correspond to the two edge zones. Each of the plurality of bridging elements is connected with the elongated side elements. The plurality of bridging elements corresponds to the spacing zones.

9 Claims, 9 Drawing Sheets

(56) References Cited

FOREIGN PATENT DOCUMENTS

| | | |
|---|---|---|
| TW | I248874 B | 2/2006 |
| TW | I299972 | 8/2008 |
| TW | 201245022 A | 11/2012 |

OTHER PUBLICATIONS

Dr. Heng-Tien Lin, "Roll-to-roll touch sensor panel fabrication process using ultra-thin flexible glass", Program & Speakers Scientific Conference—Jun. 12 & 13, 2013, LOPEC 2014—Conference Speakers Scientific Conference, 2 pages, www.lopec.com/en/conference_speakers_scientific_conference/speaker/939/?print=true.

Sean M. Garner, et al., "Electrophoretic Displays Fabricated on Ultra-Slim Flexible Glass Substrates", Journal of Display Technology, vol. 8, No. 10, Oct. 2012, pp. 590-595.

Armin Plichta, et al., "Flexible Glass Substrates", Flexible Flat Panel Displays, Edited by G. P. Crawford, 2005 John Wiley & Sons, Ltd., pp. 35-55.

Po-Yuan Lo, et al., "Flexible glass substrates for organic TFT active matrix electrophoretic displays", Corning Incorporated, SP-AR-01-01, Corning, New York, 14831, Aug. 16, 2012.

* cited by examiner

INTERLEAVING ELEMENT FOR A ROLL OF GLASS SUBSTRATE

TECHNICAL FIELD

The disclosure relates to an interleaving element for interleaving a roll of glass substrate.

BACKGROUND

The glass substrates with thickness less than 150 micrometers are called as "ultra-thin flexible glass substrates". The "ultra-thin flexible glass substrates" have better optical properties (e.g. transmittance) and are flexible. Therefore, the "ultra-thin flexible glass substrates" can be used in a variety of applications, for example, e-papers, flexible solar cells, touch panels, and OLED displays.

The "ultra-thin flexible glass substrates" are usually manufactured under a roll-to-roll process due to the flexibility of the ultra-thin flexible glass substrates. During the roll-to-roll process, different sections of a roll of glass substrate are rolled together. Specially, the radial inner sections of the glass substrate will be in contact with the adjacent radial outer sections of the glass substrate. The contact will cause that the inner sections adhere to the adjacent outer sections. Accordingly, when the glass substrate is rolled out from the roller, the glass substrates are easily broken owing to the adhesion between the sections. In additional, the electronic components disposed on the glass substrate are easily broken or damaged as well.

SUMMARY

According to an embodiment, an interleaving element is adapted to interleave a roll of glass substrate. The glass substrate comprises at least one active area, a plurality of spacing zones and two edge zones. The plurality of spacing zones and the edge zones define the active area. The interleaving element comprises two elongated side elements and a plurality of bridging elements. The elongated side elements correspond to the two edge zones. Two ends of each bridging elements are connected with the two elongated side elements, respectively. The plurality of bridging elements corresponds to the spacing zones.

BRIEF DESCRIPTION OF THE DRAWINGS

The present disclosure will become more fully understood from the detailed description given herein below for illustration, and thus does not limit the present disclosure, wherein.

DETAILED DESCRIPTION

Figure 1A:
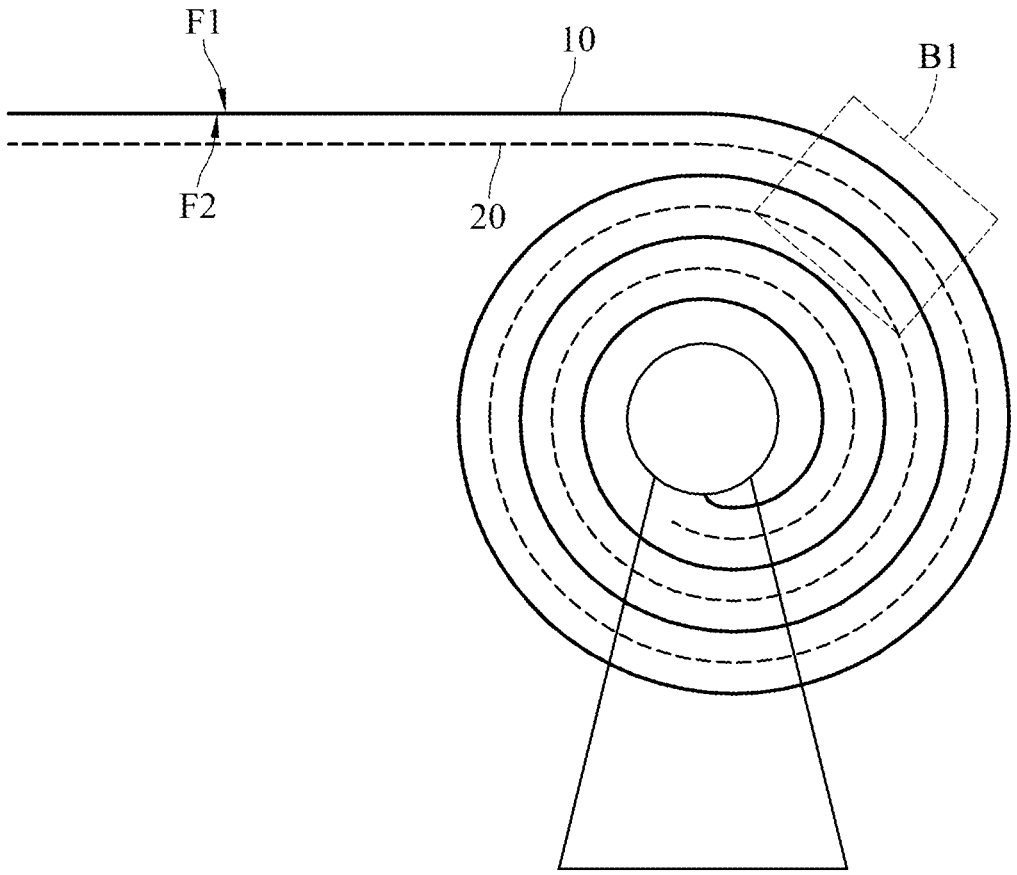
FIG. 1A is a schematic view of the first embodiment of the disclosure interleaving a roll of a glass substrate.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 1B:
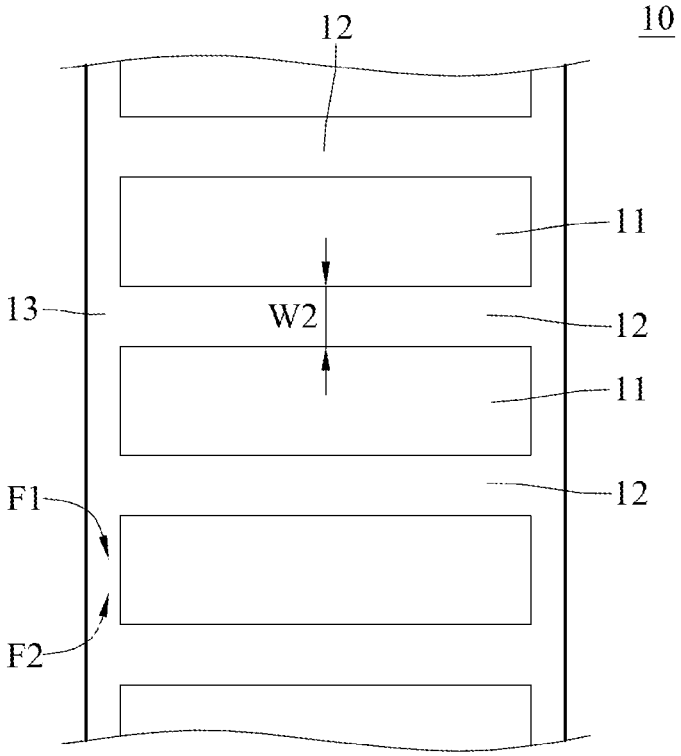
FIG. 1B is a top view of a part of the glass substrate at the region embraced by box B1 shown in FIG. 1A.
Figure 1C:
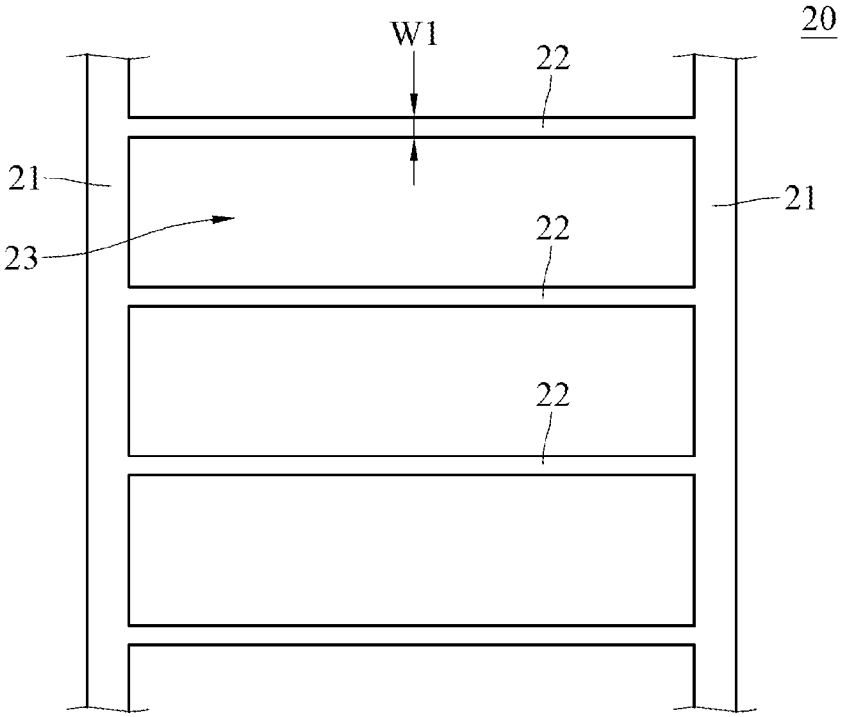
FIG. 1C is a top view of a part of the interleaving element at the region embraced by box B1 shown in FIG. 1A.
Figure 1D:
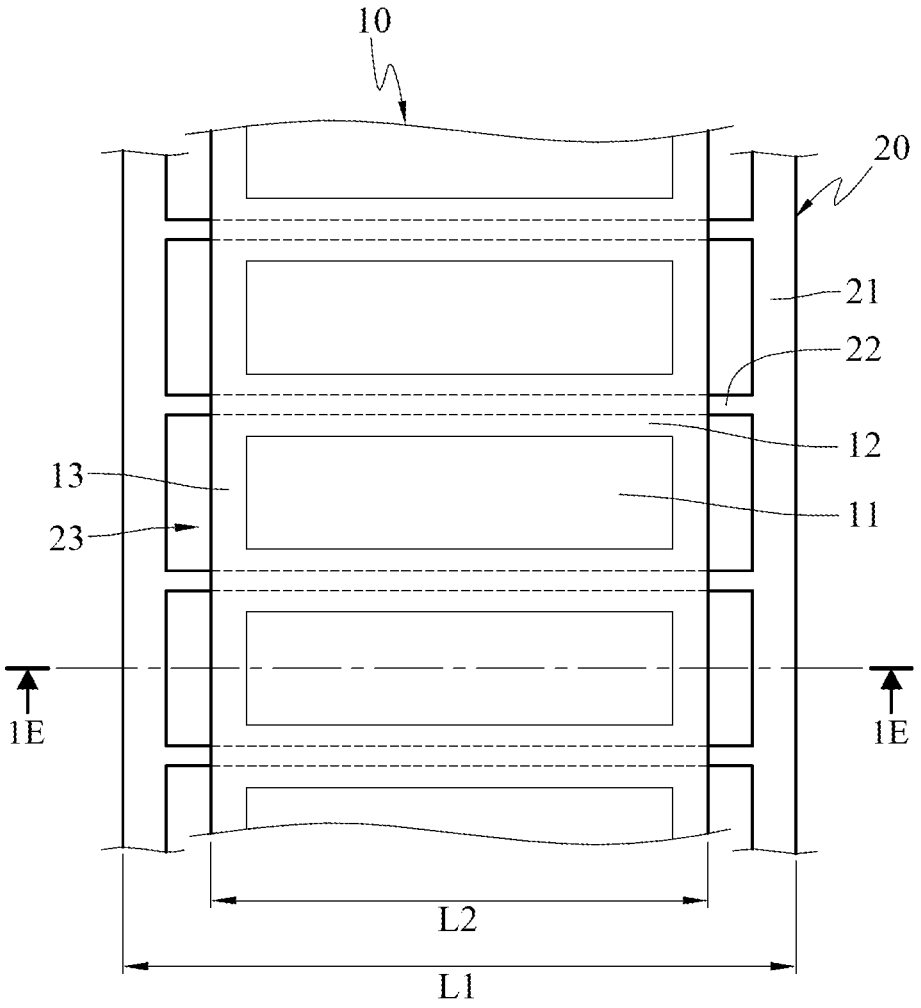
FIG. 1D is a top view of the interleaving element of FIG. 1C interleaving the glass substrate of FIG. 1B at the region embraced by box B1 shown in FIG. 1A.
Figure 1E:
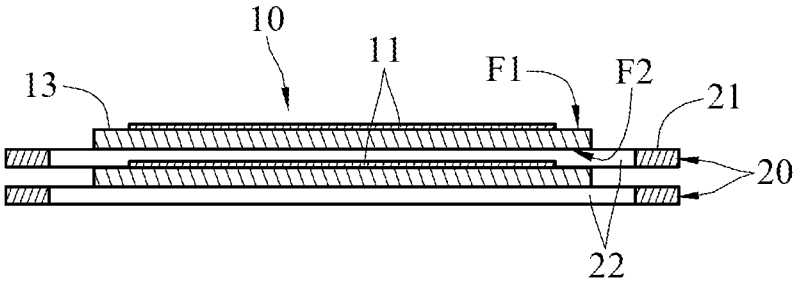
FIG. 1E is the cross-sectional view at the position 1E-1E of FIG. 1D.

First, please referring to FIGS. 1A-1E, FIG. 1A is a schematic view of the first embodiment of the disclosure interleaving a roll of a glass substrate. FIG. 1B is a top view of a part of glass substrate at the region embraced by box B1 shown in FIG. 1A. FIG. 1C is a top view of a part of the interleaving element at the region embraced by box B1 shown in FIG. 1A. FIG. 1D is a top view of the interleaving element of FIG. 1C interleaving the glass substrate of FIG. 1B at the region embraced by box B1 shown in FIG. 1A. FIG. 1E is the cross-sectional view at the position 1E-1E of FIG. 1D. In one embodiment, the surface roughness (Ra) of the glass substrates is less than 0.5 nanometers (nm) or the surface roughness (Rpv) of the glass substrates is less than 20 nm. The interleaving element is adapted to interleave the glass substrates so as to improve the above problems.

The glass substrate 10 has a first surface F1 and a second surface F2, which is opposite to the first surface F1. The glass substrate 10 comprises at least one active area 11, a plurality of spacing zones 12 and two edge zones 13. The active area 11 is defined by the spacing zones 12 and the two edge zones 13. In this embodiment, the active area 11, the plurality of spacing zones 12 and the two edge zones 13 are on the first surface F1 of the glass substrate 10. The thickness of the glass substrate 10 is less than or equal to 150 micrometers and the glass substrate 10 is flexible. Therefore, the glass substrate 10 is capable of being manufactured by a roll-to-roll process. However, the first surface F1 of the inner section (along the radial direction) of the glass substrate 10 would adhere to the second surface F2, which faces the first surface F1, of the outer section (along the radial direction) of the glass substrate 10 during the roll-to-roll process.

The active area 11 represents the working section of the glass substrate 10. For example, electronic components (i.e. circuits, sensors or liquid crystal cells . . . ) are disposed within the active area 11 of the glass substrate 10. In other words, electronic components are not disposed on the spacing zones 12 or the edge zones 13.

The interleaving element 20 is adapted to interleave the roll of glass substrate 10. The interleaving element 20 comprises two elongated side elements 21 and a plurality of bridging elements 22. In FIGS. 1B and 1C, four bridging elements 22 are shown in the figures. However, the number of the bridging elements 22 does not limit to the disclosure.

Two ends of each bridging elements 22 are connected with the two elongated side elements 21, respectively. The two elongated side elements 21 and the plurality of bridging elements 22 define at least a hollowed section 23, which is the opening defined by the two elongated side elements 21 and the plurality of bridging elements 22.

The elongated side elements 21 correspond to the two edge zones 13 so that the edge zones 13 are disposed within the elongated side elements 21 when the interleaving element 20 is stacked with the glass substrate 10. The plurality of bridging elements 22 correspond to the spacing zones 12 and the widths W1 of the bridging elements 22 are narrower than or equal to the widths W2 of the corresponding spacing zones 12. Therefore, the plurality of bridging elements 22 is disposed within the spacing zones 12 when the interleaving element 20 is stacked within the glass substrate 10. The hollowed section 23 corresponds to the active area 11 and the area of the hollowed section 23 is greater than or equal to the area of the active area 11. Therefore, the active area 11 is disposed within the hollowed section 23 when the interleaving element 20 is stacked within the glass substrate 10. Accordingly, when the interleaving element 20 is stacked within the roll of glass substrate 10 (so as to interleave the roll of glass substrate 10), the edge zones 13 are disposed within the elongated side elements 21 as well as the bridging elements 22 are disposed in the spacing zones 12. Further, the active area 11 is located in the hollowed section 23. Therefore, the active area 11, which is on the first surface F1 of the inner section (along the radial direction) of the glass substrate 10, does not contact the second surface F2 of the outer section (along the radial direction) of the glass substrate 10. Therefore, the active area 11 does not adhere to the second surface F2 of the glass substrate 10. Also, the first surface F1 of the inner section (along the radial direction) of the glass substrate 10 does not adhere to the second surface F2 of the outer section (along the radial direction) of the glass substrate 10. Accordingly, when one separates the roll of glass substrate, the glass substrate would not be broken, and the electronic components disposed on the glass substrates would not be broken or damaged.

In this embodiment, the elongated side elements 21 and the plurality of bridging elements 22 are formed in one piece. The elongated side elements 21 are, for example, plate-shaped, but the disclosure is not limited thereto. The elongated side elements 21 and the bridging elements 22 are made of plastic (i.e. Polyetheylen terephthalate, Polyethylene Naphthalate, Polymide . . . ), paper, or metal foil, but the disclosure is not limited thereto. In some other embodiments, the material of the elongated side elements 21 is different from the material of the plurality of bridging elements 22.

Figure 1F:
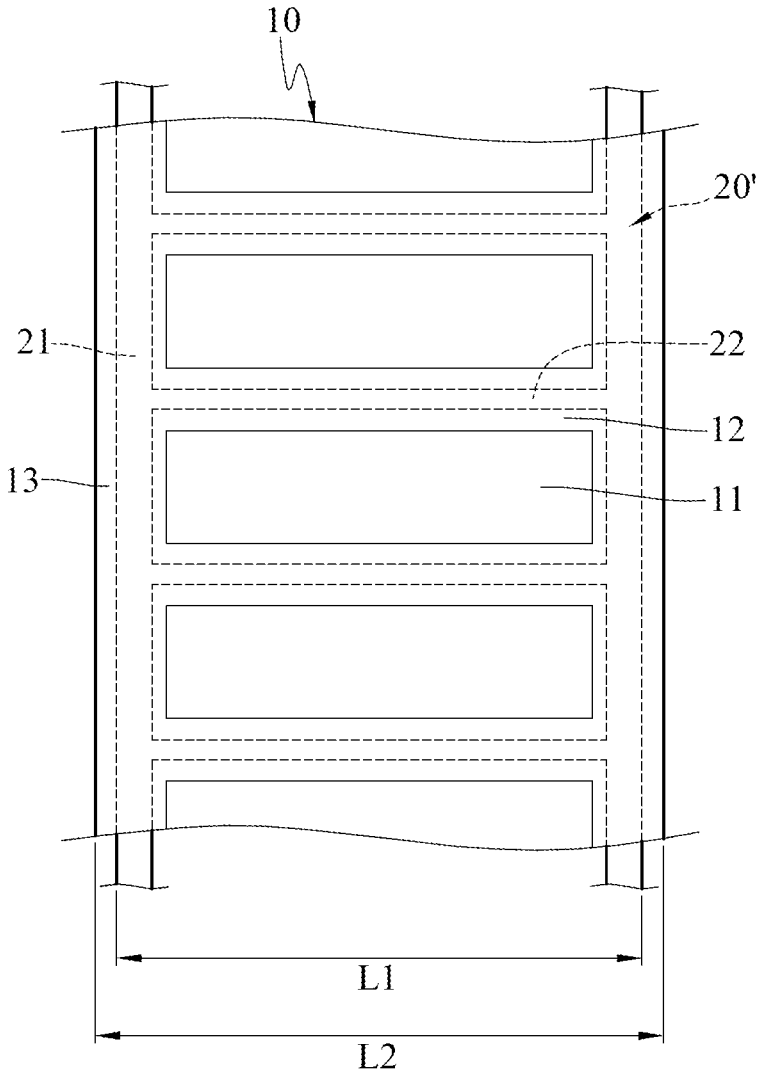
FIG. 1F is a top view of an interleaving element interleaving a roll of glass substrate according to the second embodiment of the disclosure.

As shown in FIG. 1D, the width L1 of the interleaving element 20 is greater than the width L2 of the glass substrate 10, but the disclosure is not limited thereto. Please refer to FIG. 1F. FIG. 1F is a top view of an interleaving element interleaving a roll of glass substrate according to the second embodiment of the disclosure. In this embodiment, the width L1 of the interleaving element 20' is smaller than the width L2 of the glass substrate 10. In this embodiment, when the interleaving element 20' is stacked within the roll of glass substrate 10, the elongated side elements 21 are disposed in the edge zones 13.

Figure 2A:
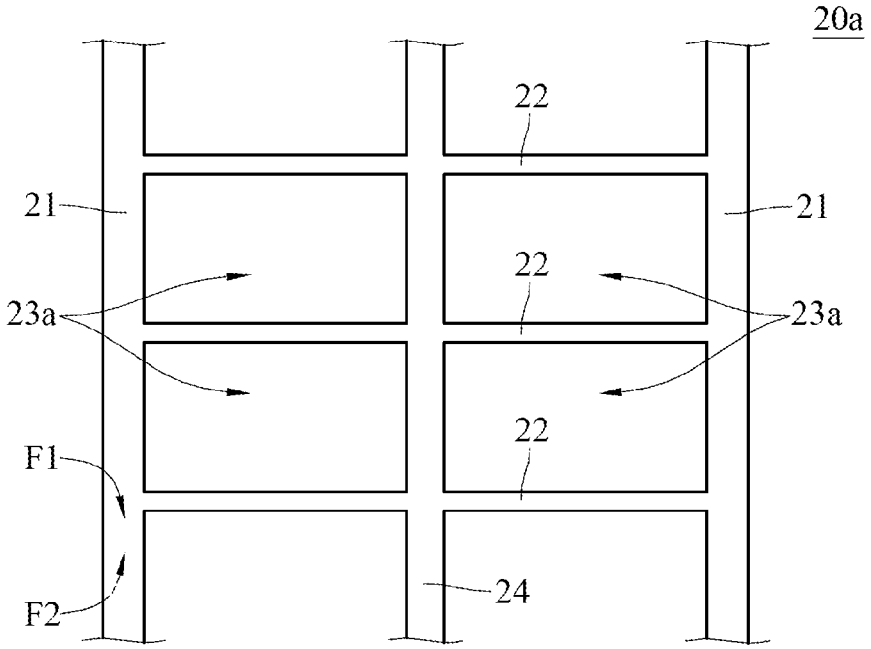
FIG. 2A is a top view of a part of an interleaving element according to the third embodiment of the disclosure.
Figure 2B:
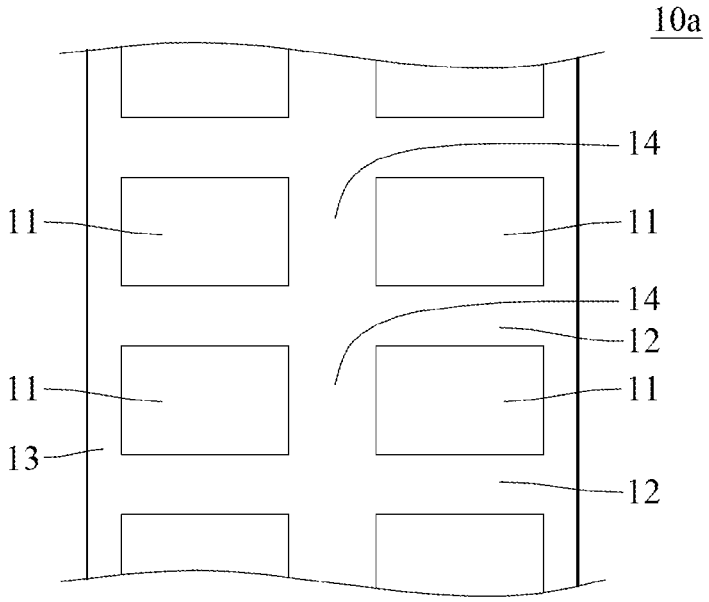
FIG. 2B is a top view of a part of glass substrate according to the third embodiment of the disclosure.
Figure 2C:
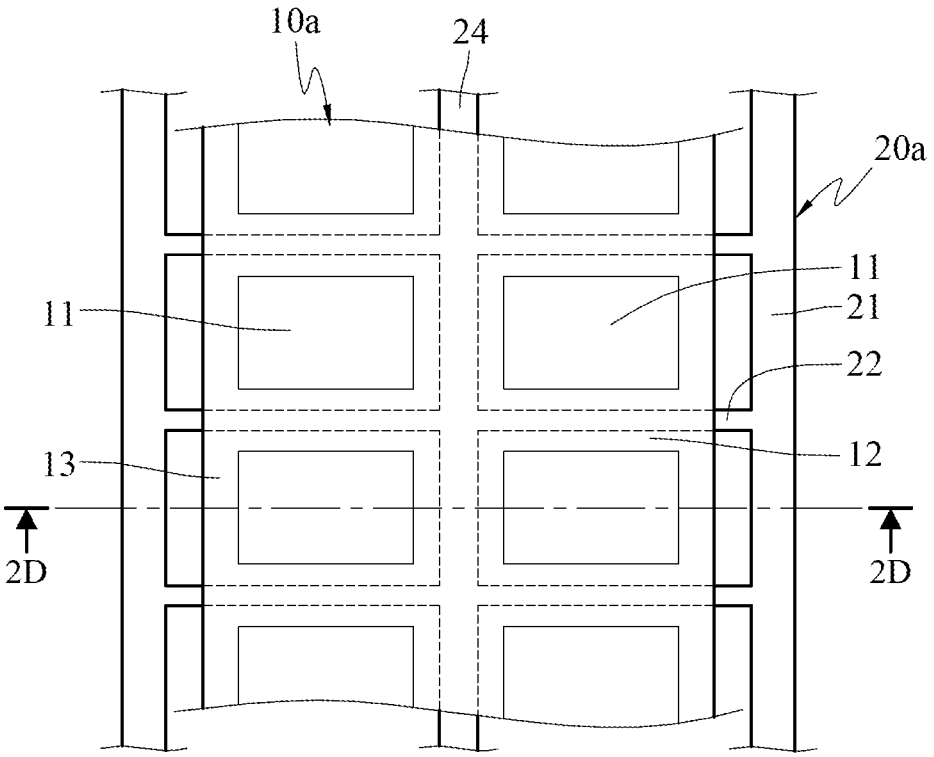
FIG. 2C is a top view of the interleaving element of FIG. 2A interleaving the glass substrate of FIG. 2B.
Figure 2D:
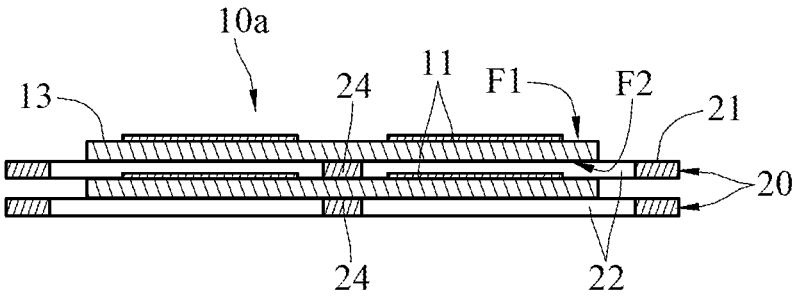
FIG. 2D is the cross-sectional view at the position 2D-2D of FIG. 2C.

Please refer to FIGS. 2A-2D. FIG. 2A is a top view of a part of an interleaving element according to the third embodiment of the disclosure. FIG. 2B is a top view of a part of glass substrate according to the third embodiment of the disclosure. FIG. 2C is a top view of the interleaving element of FIG. 2A interleaving the glass substrate of FIG. 2B. FIG. 2D is the cross-sectional view at the position 2D-2D of FIG. 2C. In this embodiment, the interleaving element 20*a* comprises two elongated side elements 21, a plurality of bridging elements 22 and at least one interconnecting element 24. The interconnecting element 24 is connected with two adjacent bridging elements 22. In FIGS. 2A and 2C, one interconnecting element 24 and four bridging element 22 are shown in the figures. Therefore, the interconnecting element 24, the bridging elements 22 and the two elongated side elements 21 define four hollowed sections 23*a* together.

The glass substrate 10*a* comprises at least one active area 11, a plurality of first spacing zones 12, two edge zones 13, and a plurality of second spacing zones 14. The first spacing zones 12, the edge zones 13 and the second spacing zones 14 define the active areas 11.

The two elongated side elements 21 correspond to the two edge zones 13. The bridging elements 22 correspond to the first spacing zones 12. The hollowed sections 23*a* correspond to the two active areas 11 of the glass substrate 10*a*. The interconnecting element 24 corresponds to the second spacing zones 14. As shown in FIG. 2C, when the interleaving element 20*a* is stacked within the roll of glass substrate 10*a* (so as to interleave the roll of glass substrate 10*a*), each of the four active areas 11 is at the corresponding hollowed section 23*a*. Therefore, the active areas 11, which are on the first surface F1 of the inner section (along the radial direction) of the glass substrate 10*a*, do not contact the second surface F2 of the outer section (along the radial direction) of the glass substrate 10*a*, so that the active areas 11 do not adhere to the second surface F2 of the glass substrate 10*a*.

Figure 3:
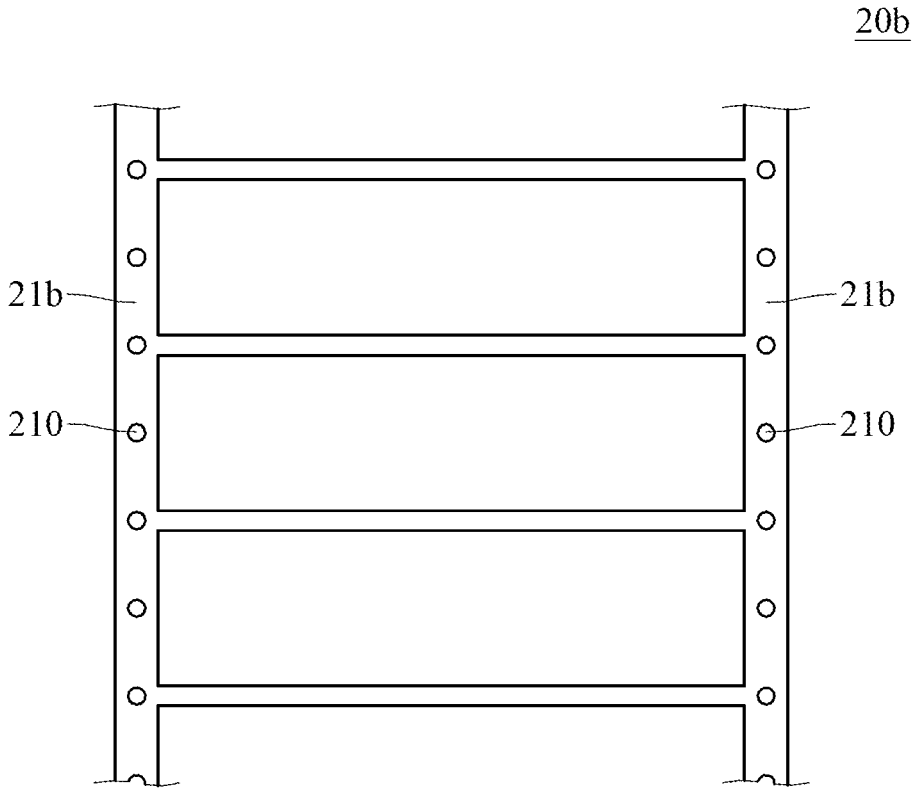
FIG. 3 is a top view of a part of an interleaving element according to the fourth embodiment of the disclosure.

Please referring to FIG. 3, FIG. 3 is a top view of a part of an interleaving element according to the fourth embodiment of the disclosure. In this embodiment, each of the two elongated side elements 21*b* has a plurality of perforations 210. The plurality of perforations 210 corresponds to the teeth of sprocket wheels (not shown), so that it is more convenient to handle the interleaving element 20*b* during the roll-to-roll process.

Figure 4A:
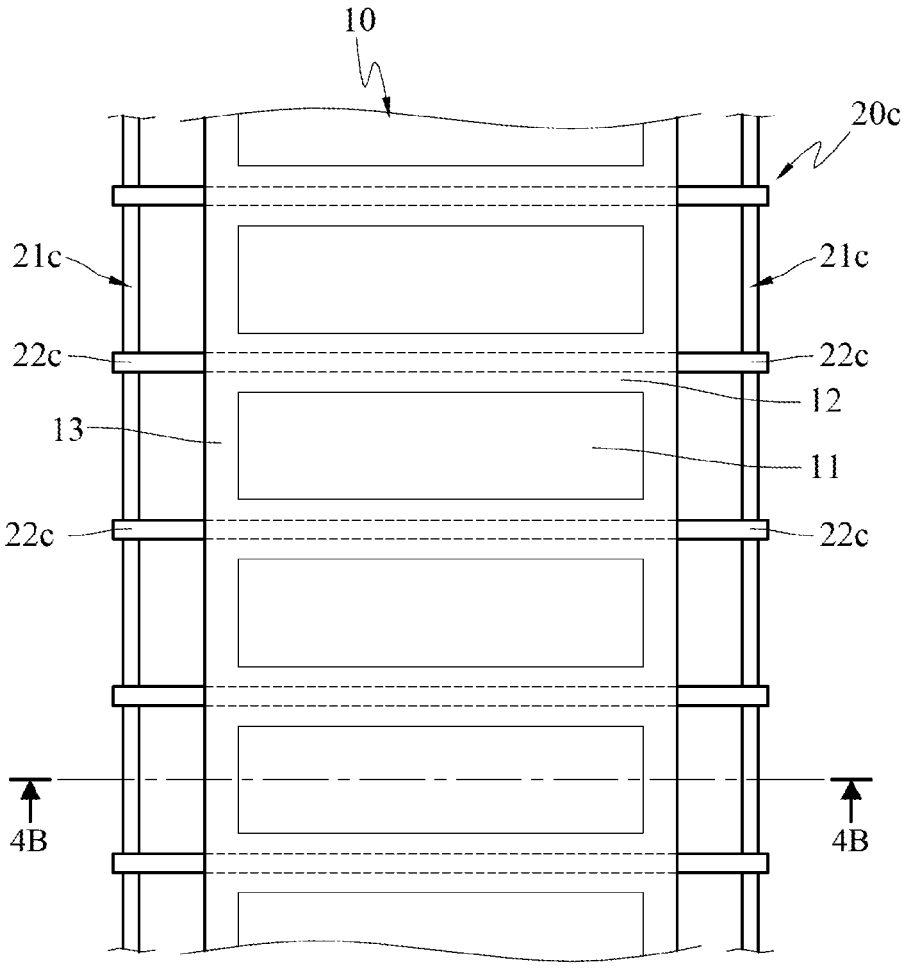
FIG. 4A is a top view of a part of an interleaving element interleaving a glass substrate according to the fifth embodiment of the disclosure.
Figure 4B:
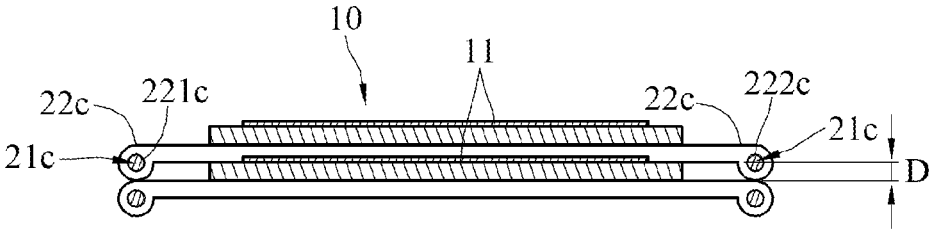
FIG. 4B is the cross-sectional view at the position 4B-4B of FIG. 4A.

Please referring to FIGS. 4A and 4B, FIG. 4A is a top view of a part of an interleaving element interleaving a glass substrate according to the fifth embodiment of the disclosure. FIG. 4B is the cross-sectional view at the position 4B-4B of FIG. 4A. In this embodiment, the interleaving element 20*c* comprises two elongated side elements 21*c* and a plurality of bridging elements 22*c*. Each bridging elements 22*c* has a first sleeve 221*c* at one end and a second sleeve 222*c* at the other end. One elongated side element 21*c* passes through the first sleeves 221*c*. The other elongated side element 21*c* passes through the second sleeves 222*c*. The elongated side elements 21*c* are, for example, iron wires, but the disclosure is not limited thereto. In this embodiment, when the interleaving element 20*c* is stacked within the roll of glass substrate 10, the glass substrate 10 is supported by the first sleeves 221*c* and the second sleeves 222*c*, so that an interval D is kept. The interval D corresponds to the thickness of the glass substrate 10. In other words, the height of the interval D is greater than or equal to the thickness of the glass substrate 10.

Figure 5:
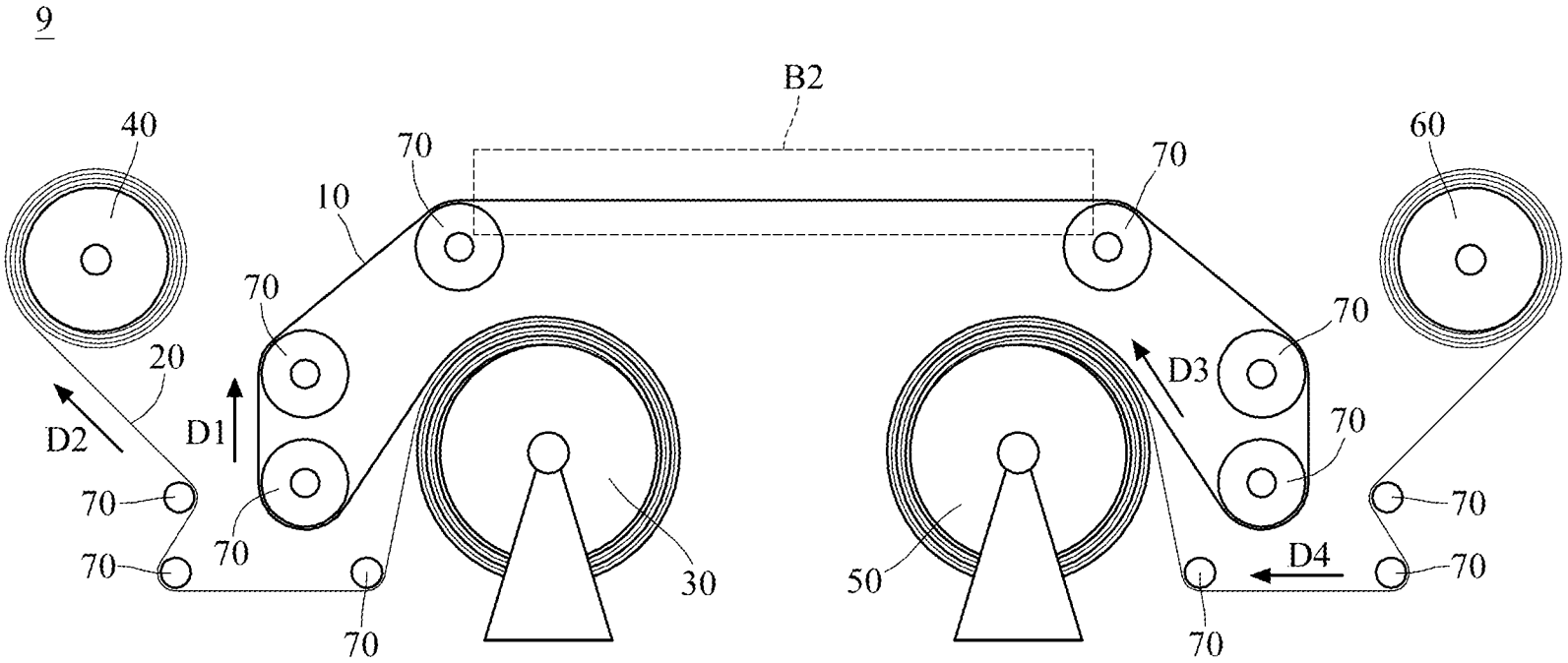
FIG. 5 is a schematic view of the interleaving element of FIG. 1C interleaving the glass substrate of FIG. 1B in a roll-to-roll process.

Finally, please referring to FIG. 5. FIG. 5 is a schematic view of the interleaving element of FIG. 1C interleaving the glass substrate of FIG. 1B in a roll-to-roll process. FIG. 5 describes how to apply the interleaving element in a roll-to-roll process. In FIG. 5, a machine 9 is adapted for manufacturing a roll of glass substrate 10 under a roll-to-roll process. As shown in FIG. 5, the interleaving element 20 can be adapted for interleaving the glass substrate 10. The followings describe how to unload the glass substrate 10 and how to load the glass substrate 10. In FIG. 5, directing rolls 70 are adapted for directing the glass substrate 10 and/or the interleaving element 20.

In this embodiment, the elongated side elements (not shown) of the interleaving element 20 is clamped by holders (not shown), but the disclosure is not limited thereto. The holders are capable of retaining the interleaving element 20 in the machine 9.

When the glass substrate 10 is unloaded from a first roll 30 and moves along a first direction D1, the interleaving element 20 stacked between different sections of the roll of glass substrate 10 moves toward a second roll 40 along a second direction D2. Thus, the interleaving element 20 and the glass substrate 10 are separated and the glass substrate 10 is loaded.

When the glass substrate 10 is loaded to a third roll 50 along a third direction D3, the interleaving element 20 moves toward a fourth roll 60 along a fourth direction D4. Thus, the interleaving element 20 and the glass substrate 10 are rolled together, the interleaving element 20 is stacked between different sections of the roll of glass substrate 10, and the glass substrate 10 is unloaded.

At box B2, different processes can be applied to the glass substrate 10. For example, grinding, polishing, cleaning of the glass substrate 10, or the deposition of additional layers and/or components (e.g. electronic components) on the glass substrate 10 can be applied.

According to the interleaving element of the disclosure, when the interleaving element is interleaved by the roll of glass substrate, the elongated side elements correspond to the edge zones, the bridging elements are disposed in the spacing zones, as well as the active area is located in the hollowed section. Therefore, the active area does not contact or adhere to the second surface of the outer section of the glass substrate. Also, the first surface of the inner section of the glass substrate does not adhere to the second surface of the outer section of the glass substrate. Therefore, it is more convenient to separate the roll of the glass substrate and the glass substrate or the active areas are not damaged during the separation.

In some other embodiments, the interleaving element further comprises at least one interconnecting element. The number of hollowed sections is varied by the number of the interconnecting element. Therefore, the user can then adapt an interleaving element having an appropriate number of hollowed sections so as to interleave the glass substrate having the corresponding number of active areas.

In some other embodiments, the elongated side elements further have a plurality of perforations corresponding to the teeth of sprocket wheels, so that it is more convenient to handle the interleaving element during the roll-to-roll process.

In some other embodiments, each bridging elements has a first sleeve at one end and a second sleeve at the other end. One elongated side element passes through the first sleeves and the other elongated side element passes through the second sleeves. Therefore, when the interleaving element is stacked between different sections of the roll of glass substrate, an interval corresponding to the thickness of the glass substrate is kept the sleeves.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An interleaving element, adapted to interleave a roll of glass substrate, the glass substrate comprising at least one active area, a plurality of spacing zones and two edge zones, the plurality of spacing zones and the edge zones defining the active area, the interleaving element comprising:

two elongated side elements corresponding to the two edge zones; and a plurality of bridging elements, two ends of each bridging elements connected with the two elongated side elements, respectively, the plurality of bridging elements corresponding to the spacing zones;

wherein, each bridging elements has a first sleeve at one end and a second sleeve at the other end, one elongated side element passes through the first sleeves and the other elongated side element passes through the second sleeves.

2. The interleaving element according to claim 1, wherein the elongated side elements and the plurality of bridging elements are formed in one piece.

3. The interleaving element according to claim 2, wherein the material of the interleaving element comprises plastic, paper, or metal foil.

4. The interleaving element according to claim 1, wherein the widths of the bridging elements are narrower than or equal to the widths of the corresponding spacing zones.

5. The interleaving element according to claim 1, wherein the material of the elongated side elements is different from the material of the plurality of bridging elements.

6. The interleaving element according to claim 1, further comprising at least one interconnecting element, two ends of the interconnecting element connected with two adjacent bridging elements, the interconnecting element corresponding to one of the spacing zones.

7. The interleaving element according to claim 1, wherein the width of the interleaving element is greater than the width of the glass substrate.

8. The interleaving element according to claim 1, wherein the width of the interleaving element is smaller than the width of the glass substrate.

9. The interleaving element according to claim 1, wherein each of the two elongated side elements has a plurality of perforations.

* * * * *